US010865035B1

(12) United States Patent
Zitoli

(10) Patent No.: US 10,865,035 B1
(45) Date of Patent: Dec. 15, 2020

(54) DISPOSABLE GLOVE DISPENSING ASSEMBLY

(71) Applicant: Joe Zitoli, Toronto (CA)

(72) Inventor: Joe Zitoli, Toronto (CA)

( * ) Notice: Subject to any disclaimer, the term of this patent is extended or adjusted under 35 U.S.C. 154(b) by 0 days.

(21) Appl. No.: 16/891,472

(22) Filed: Jun. 3, 2020

(51) Int. Cl.

| | |
|---|---|
| ***B65D 83/08*** | (2006.01) |
| ***B65D 85/18*** | (2006.01) |
| ***A41D 19/00*** | (2006.01) |
| ***B65D 25/22*** | (2006.01) |

(52) U.S. Cl.
CPC ..... *B65D 83/08* (2013.01); *A41D 19/0055* (2013.01); *B65D 25/22* (2013.01); *B65D 85/18* (2013.01); *A41D 2400/52* (2013.01)

(58) Field of Classification Search
None
See application file for complete search history.

(56) References Cited

U.S. PATENT DOCUMENTS

| | | | | |
|---|---|---|---|---|
| 4,240,157 | A | 12/1980 | Peters | |
| 4,745,635 | A | 5/1988 | Kinnear | |
| 5,096,089 | A | 3/1992 | McLaughlin | |
| D344,369 | S | 2/1994 | Brown | |
| 6,643,846 | B2 | 11/2003 | Turner-Antonsen | |
| 8,132,692 | B2 | 3/2012 | Jordan | |
| 8,960,493 | B1 * | 2/2015 | Dennison | A41D 19/015 221/45 |
| 2001/0037516 | A1 * | 11/2001 | Grinberg | A47G 25/904 2/161.6 |
| 2006/0049199 | A1 * | 3/2006 | West | A61B 42/40 221/26 |
| 2007/0215628 | A1 * | 9/2007 | Tramontina | B65D 83/0817 221/35 |
| 2007/0215635 | A1 * | 9/2007 | Tramontina | A61B 42/40 221/270 |
| 2016/0029720 | A1 | 2/2016 | Lopez-Rocafort | |
| 2016/0051330 | A1 * | 2/2016 | Cosentino, II | A61B 50/20 221/45 |

FOREIGN PATENT DOCUMENTS

| | | |
|---|---|---|
| EP | 2216252 | 11/2010 |

* cited by examiner

*Primary Examiner* — Gene O Crawford
*Assistant Examiner* — Ayodeji T Ojofeitimi

(57) ABSTRACT

A disposable glove dispensing assembly includes a panel that is mountable to an inwardly facing surface of a gas cap door on a vehicle. In this way the panel is accessible to a user when the gas cap door is opened. A net is coupled to the panel and the net has a top edge that is spaced from the panel thereby facilitating the net to form a storage pouch. A glove is provided and the glove is wearable by a user. The glove is stored within the net such that the glove is accessible to the user when the user opens the gas cap door. The glove is comprised of a fluid impermeable material to protect the user from bacteria and germs on a refueling handle of a gas pump.

6 Claims, 3 Drawing Sheets

DISPOSABLE GLOVE DISPENSING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to glove dispensing devices and more particularly pertains to a new glove dispensing device for protecting a user from bacteria and germs on a gas pump.

(2) Description of Related Art Including Information Disclosed Under 37 CFR 1.97 and 1.98

The prior art relates to glove dispensing devices including a glove that has a mount integrated therein for mounting on a gas cap door of a vehicle. Additionally, the prior art discloses a glove that has a plurality of blisters integrated therein for insulating a user's hand from cold metal parts of a gas pump handle. The prior art also discloses a glove dispenser that is structure to enhance removing a single glove therefrom. Additionally, the prior art discloses a glove that is comprised of a gasoline impermeable material for wearing during refueling procedures on a vehicle.

BRIEF SUMMARY OF THE INVENTION

An embodiment of the disclosure meets the needs presented above by generally comprising a panel that is mountable to an inwardly facing surface of a gas cap door on a vehicle. In this way the panel is accessible to a user when the gas cap door is opened. A net is coupled to the panel and the net has a top edge that is spaced from the panel thereby facilitating the net to form a storage pouch. A glove is provided and the glove is wearable by a user. The glove is stored within the net such that the glove is accessible to the user when the user opens the gas cap door. The glove is comprised of a fluid impermeable material to protect the user from bacteria and germs on a refueling handle of a gas pump.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
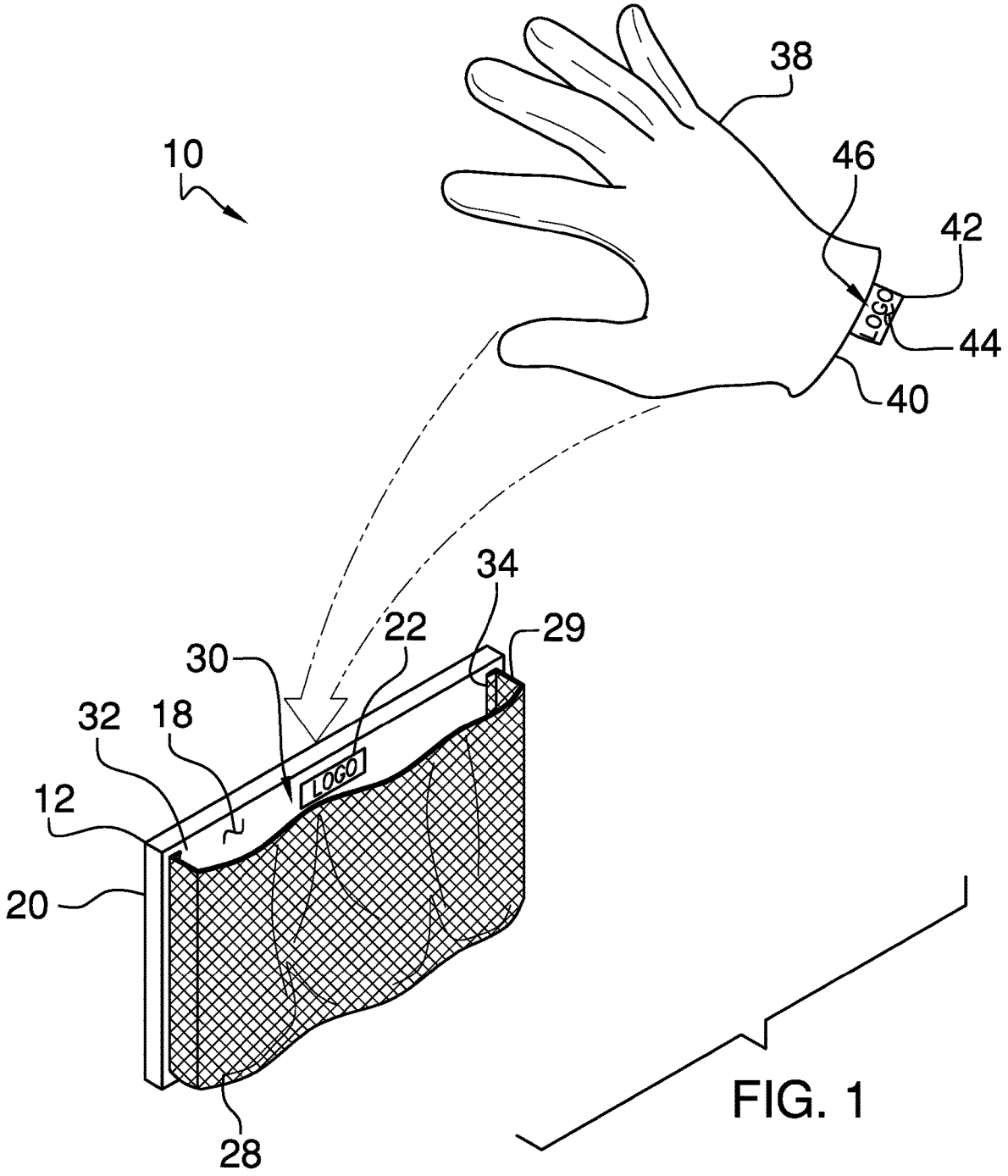
FIG. 1 is a perspective view of a disposable glove dispensing assembly according to an embodiment of the disclosure.
Figure 2:
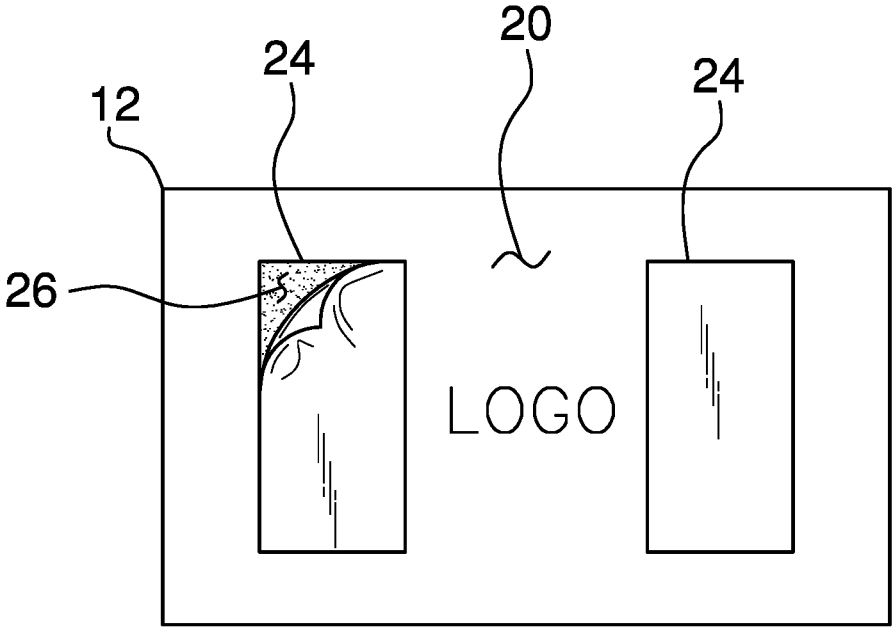
FIG. 2 is a back view of a panel of an embodiment of the disclosure.
Figure 3:
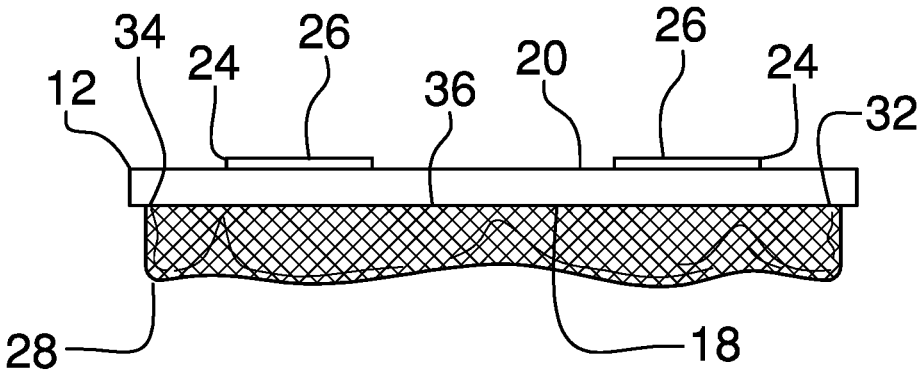
FIG. 3 is a bottom view of a panel and a net an embodiment of the disclosure.
Figure 4:
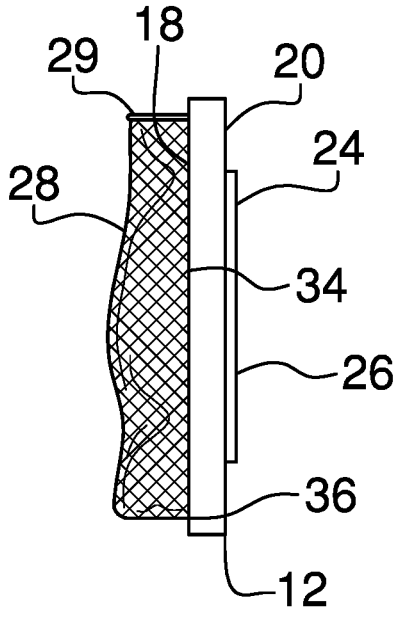
FIG. 4 is a left side view of panel and a net of an embodiment of the disclosure.
Figure 5:
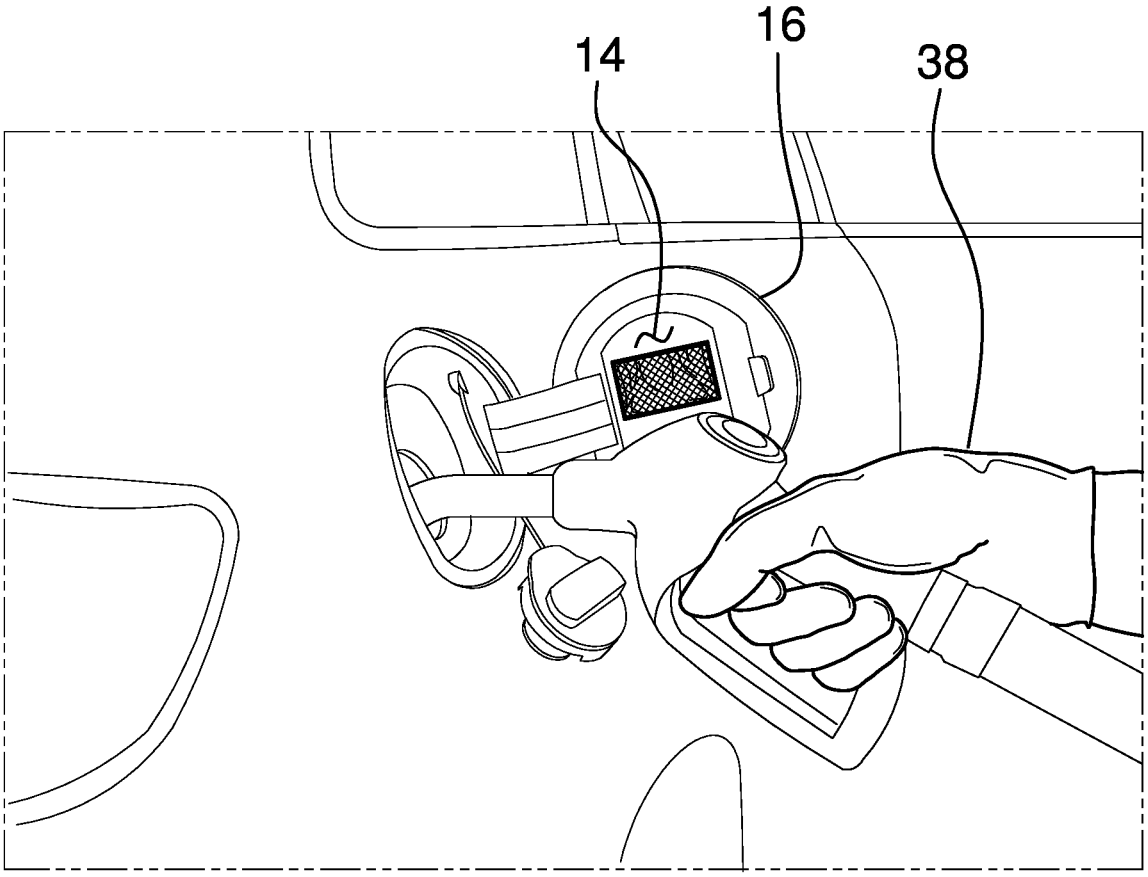
FIG. 5 is a perspective in-use view of an embodiment of the disclosure.

With reference now to the drawings, and in particular to FIGS. 1 through 5 thereof, a new glove dispensing device embodying the principles and concepts of an embodiment of the disclosure and generally designated by the reference numeral 10 will be described.

As best illustrated in FIGS. 1 through 5, the disposable glove dispensing assembly 10 generally comprises a panel 12 that is mountable to an inwardly facing surface 14 of a gas cap door 16 on a vehicle. In this way the panel 12 is accessible to a user when the gas cap door 16 is opened. The vehicle may be a passenger vehicle, a cargo vehicle or any other motorized vehicle that burns petroleum products, such as gasoline or diesel, for fuel. The panel 12 has a front surface 18 and a back surface 20, and the front surface 18 has logo indicia 22 printed thereon comprising an image or a logo.

A plurality of mating members 24 is each coupled to the panel 12 and each of the mating members 24 releasably engages the inwardly facing surface 14 of the gas cap door 16. Each of the mating members 24 is positioned on the back surface 20 of the panel 12 and each of the mating members 24 has an exposed surface 26 with respect to the panel 12. The exposed surface 26 of each of the mating members 24 releasably engages the inwardly facing surface 14 of the gas cap door 16. Each of the mating members 24 may comprise an adhesive strip, hook and loop fasteners or any other type of releasable mating member.

A net 28 is coupled to the panel 12 and the net 28 has a top edge 29 that is spaced from the panel 12 thereby facilitating the net 28 to form a storage pouch 30. The net 28 has a first lateral edge 32, a second lateral edge 34 and a bottom edge 36. Each of the first lateral edge 32, the second lateral edge 34 and the bottom edge 36 is coupled to the front surface 18 of the panel 12. The top edge 29 is free from the front surface 18 to access an interior of the storage pouch 30 defined by the net 28.

A glove 38 is provided and the glove 38 is wearable by a user. The glove 38 is stored within the net 28 such that the glove 38 is accessible to the user when the user opens the gas cap door 16. In this way the user can wear the glove 38 prior to refueling the vehicle. The glove 38 is comprised of a fluid impermeable material wherein to protect the user from bacteria and germs on a refueling handle of a gas pump. Additionally, the glove 38 is comprised of a biodegradable material to facilitate the glove 38 to decay over time.

The glove 38 is removable from the storage pouch 30 defined by the net 28 when the gas cap door 16 is opened. The glove 38 has a cuff 40 and the glove 38 has a tag 42 coupled to and extending away from the cuff 40. The tag 42 has a first surface 44 that is exposed when the glove 38 is worn. Additionally, the first surface 44 has logo indicia 46 printed thereon comprising an image or logo that matches the logo indicia 22 on the panel 12.

In use, the panel 12 is mounted to the gas cap door 16 on the vehicle. In this way the glove 38 is accessible to the user when the user opens the gas cap door 16. The user removes the glove 38 from the net 28 to wear prior to refueling the vehicle. In this way the glove 38 inhibits the transfer of germs and bacteria between the refueling handle on the gas pump and the user. The glove 38 is replaced in the net 28 when refueling is completed. Moreover, the glove 38 degrades over a period of time of at least three months.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A disposable glove dispensing assembly being attachable to a gas cap door on a vehicle thereby facilitating a disposable glove to be available to a user during refueling operations, said assembly comprising:

a panel being mountable to an inwardly facing surface of a gas cap door on a vehicle wherein said panel is configured to be accessible to a user when the gas cap door is opened;

a plurality of mating members, each of said mating members being coupled to said panel, each of said mating members releasably engaging the inwardly facing surface of the gas cap door;

a net being coupled to said panel, said net having an top edge being spaced from said panel thereby facilitating said net to form a storage pouch; and a glove being wearable by a user, said glove being stored within said net wherein said glove is configured to be accessible to the user when the user opens the gas cap door, said glove being comprised of a fluid impermeable material wherein glove is configured to protect the user from bacteria and germs on a refueling handle of a gas pump, said glove being removable through said storage space defined by said net when the gas cap door is opened.

2. The assembly according to claim 1, wherein said glove is comprised of a biodegradable material wherein said glove is configured to decay over time.

3. The assembly according to claim 1, wherein said glove has a cuff, said glove having a tag being coupled to and extending away from said cuff, said tag having a first surface being exposed when said glove is worn, said first surface having logo indicia being printed thereon comprising an image or logo that matches logo indicia on said panel.

4. The assembly according to claim 1, wherein:

said panel has a front surface and a back surface, said front surface having logo indicia being printed thereon comprising an image or a logo; and each of said mating members is positioned on said back surface of said panel, each of said mating members having an exposed surface with respect to said panel, said exposed surface of each of said mating members releasably engaging the inwardly facing surface of the gas cap door.

5. The assembly according to claim 4, wherein said net has a first lateral edge, a second lateral edge and a bottom edge, each of said first lateral edge, said second lateral edge and said bottom edge being coupled to said front surface of said panel, said top edge being free from said front surface to access an interior of said storage pouch defined by said net.

6. A disposable glove dispensing assembly being attachable to a gas cap door on a vehicle thereby facilitating a disposable glove to be available to a user during refueling operations, said assembly comprising:

a panel being mountable to an inwardly facing surface of a gas cap door on a vehicle wherein said panel is configured to be accessible to a user when the gas cap door is opened, said panel having a front surface and a back surface, said front surface having logo indicia being printed thereon comprising an image or a logo;

a plurality of mating members, each of said mating members being coupled to said panel, each of said mating members releasably engaging the inwardly facing surface of the gas cap door, each of said mating members being positioned on said back surface of said panel, each of said mating members having an exposed surface with respect to said panel, said exposed surface of each of said mating members releasably engaging the inwardly facing surface of the gas cap door;

a net being coupled to said panel, said net having an top edge being spaced from said panel thereby facilitating said net to form a storage pouch, said net having a first lateral edge, a second lateral edge, and a bottom edge, each of said first lateral edge, said second lateral edge and said bottom edge being coupled to said front surface of said panel, said top edge being free from said front surface to access an interior of said storage pouch defined by said net; and a glove being wearable by a user, said glove being stored within said net wherein said glove is configured to be accessible to the user when the user opens the gas cap door, said glove being comprised of a fluid impermeable material wherein said glove is configured to protect the user from bacteria and germs on a refueling handle of a gas pump, said glove being comprised of a biodegradable material wherein said glove is configured to decay over time, said glove being removable through said storage space defined by said net when the gas cap door is opened, said glove having a cuff, said glove having a tag being coupled to and extending away from said cuff, said tag having a first surface being exposed when said glove is worn, said first surface having logo indicia being printed thereon comprising an image or logo that matches said logo indicia on said panel.

* * * * *